US007380419B2

(12) United States Patent
Miyamoto

(10) Patent No.: US 7,380,419 B2
(45) Date of Patent: Jun. 3, 2008

(54) MOVABLE SINKER APPARATUS AND SINKER OF WEFT KNITTING MACHINE

(75) Inventor: Masaki Miyamoto, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 61 days.

(21) Appl. No.: 10/594,498

(22) PCT Filed: Mar. 29, 2005

(86) PCT No.: PCT/JP2005/005962

§ 371 (c)(1),
(2), (4) Date: Sep. 28, 2006

(87) PCT Pub. No.: WO2005/095698

PCT Pub. Date: Oct. 13, 2005

(65) Prior Publication Data

US 2008/0034805 A1 Feb. 14, 2008

(30) Foreign Application Priority Data

Mar. 31, 2004 (JP) ..... 2004-103185

(51) Int. Cl.
*D04B 15/06* (2006.01)

(52) U.S. Cl. ..... 66/106

(58) Field of Classification Search ..... 66/64, 66/104, 105, 106
See application file for complete search history.

(56) References Cited

U.S. PATENT DOCUMENTS 3,326,017 A 6/1967 Tschümperlin et al.
5,134,865 A 8/1992 Shima et al.
5,231,854 A 8/1993 Schmid
5,333,473 A * 8/1994 Miyamoto ..... 66/106
5,475,991 A * 12/1995 Yabuta et al. ..... 66/106
5,570,592 A * 11/1996 Takegawa ..... 66/64

(Continued)

FOREIGN PATENT DOCUMENTS

EP 1514963 5/2003

(Continued)

*Primary Examiner*—Danny Worrell
(74) *Attorney, Agent, or Firm*—Harness, Dickey & Pierce, P.L.C.

(57) ABSTRACT

There are provided a movable sinker apparatus of a weft knitting machine and a sinker which are capable of holding and pressing down a knitting yarn of a previous loop and sufficiently pulling down a knitting fabric. At forward positions of the sinkers, second protruding portions are close to each other, and thus a knitting fabric can be sandwiched therebetween. When the front and rear needle beds are faced each other so as to be symmetric at the needle bed gap, the forces of the wire springs are applied so as to pull down the knitting fabric in the vertical direction. A knitting yarn receiving portion is formed on a first protruding portion of the front end portion on the sinker, and thus it is possible to retain a knitting yarn of a previous loop and prevent the knitting yarn from moving as the knitting needle moves forward. the second protruding portion that projects outward in a radial direction is formed on a portion close to a front end of the first protruding portion, and the knitting fabric can be sandwiched and pulled down by the second protruding portions provided on the needle beds that are opposed to each other.

1 Claim, 7 Drawing Sheets

U.S. PATENT DOCUMENTS

| | | | | |
|---|---|---|---|---|
| 5,918,483 | A * | 7/1999 | Schmid et al. | 66/64 |
| 6,014,874 | A * | 1/2000 | Shima et al. | 66/106 |
| 6,092,396 | A * | 7/2000 | Schmid et al. | 66/106 |
| 7,152,435 | B2 * | 12/2006 | Sonomura et al. | 66/106 |
| 7,174,748 | B2 * | 2/2007 | Sonomura | 66/106 |
| 2005/0183466 | A1 | 8/2005 | Morita et al. | |

FOREIGN PATENT DOCUMENTS

| | | | |
|---|---|---|---|
| EP | 1522617 | | 10/2003 |
| JP | 62-20476 | Y2 | 5/1987 |
| JP | A 3-206161 | | 9/1991 |
| JP | A 5-195384 | | 8/1993 |
| JP | 5-83657 | B2 | 11/1993 |
| JP | 2646317 | B2 | 8/1997 |
| JP | 2005-113367 | A | 4/2005 |
| WO | WO 03/102285 | A1 | 12/2003 |

* cited by examiner

MOVABLE SINKER APPARATUS AND SINKER OF WEFT KNITTING MACHINE

PRIORITY STATEMENT

This application is the national phase under 35 U.S.C. § 371 of PCT International Application No. PCT/JP2005/005962 which has an International filing date of Mar. 29, 2005, which designated the United States of America and which claims priority on Japanese Patent Application number P2004-103185 filed Mar. 31, 2004, the entire contents of which are hereby incorporated herein by reference.

TECHNICAL FIELD

The present invention generally relates to a movable sinker apparatus and/or a sinker, of a weft knitting machine. For example, it may relate to one that can press a knitting fabric and pull down the knitting fabric to a lower portion of a needle bed at an appropriate timing during knitting.

BACKGROUND ART

A movable sinker apparatus has been conventionally used that includes, between knitting needles arranged on a needle bed in a weft knitting machine, a sinker displaced by a cam mechanism provided on a carriage such that the sinker is swingingly displaced using as a fulcrum the vicinity on a needle bed gap side of the needle bed, so that the front end portion of the sinker moves forward into the needle bed gap and is withdrawn from the needle bed gap (see Japanese Examined Patent Publication JP-B2 05-83657 (1993), for example). The carriage is provided with a cam for driving the sinkers.

The front end portion of the sinker moves back and forth with respect to the side of the needle bed gap in conjunction with the travel of the carriage, and thus the front end portion can press a knitting fabric, and can be withdrawn from the needle bed gap to prevent, for example, a mechanical contact with other components in the narrow needle bed gap. The force of a spring is also applied to the sinker of the movable sinker apparatus.

When a reaction force from a knitting yarn is greater than the force of the spring, there is room in which the front end portion moves backward from the needle bed gap, and thus too strong a tensile force can be prevented from being applied to the knitting yarn. However, during stitch determination in which the knitting needle is pulled in by a stitch cam, the front end portion of the sinker is regulated so as not to be moved by the cam backward from the needle bed gap. When the carriage moves away, a state is kept in which the front end portion of the sinker has moved forward into the needle bed gap by the force of the spring.

In this movable sinker apparatus, a knitting yarn receiving portion is formed as a recessed portion on the front end side. Thus, when knitting a knitting fabric, it is possible to prevent a knitting yarn of a previous loop from moving together with the knitting needle when the knitting needle moves forward into the needle bed gap, by catching the knitting yarn of the previous loop. It should be noted that a "previous loop" refers to a knitting stitch that is formed by catching a supplied knitting yarn with a hook of the knitting needle and that is still on the knitting needle.

A movable sinker is known that has upper and lower protruding portions (see Japanese Patent No. 2646317, for example). The upper protrusion of a sinker that is disclosed in Japanese Patent No. 2646317 has a function to press a previous loop such that the previous loop does not move upward together with a knitting needle when the knitting needle is moved forward into the needle bed gap.

As shown in descriptions "catching a course in which the knitting material is newly formed" in Paragraph [0010] and "fastening action of the cam 20 on the newest course of the knitting material" in Paragraph [0012], the lower protrusion acts on a previous loop, and has a function as in JP-B2 05-83657.

The movable sinker apparatus of JP-B2 05-83657 is swingingly displaced about a base portion of the sinker, and catches and presses down a knitting stitch of a previous loop with the knitting stitch receiving portion at the front end portion. Also in the configuration of the sinker as disclosed in Japanese Patent No. 2646317, the main function of the lower protrusion is to fasten and press down a knitting stitch of a previous loop as in JP-B2 05-83657.

More specifically, the knitting stitch receiving portion of JP-B2 05-83657 and the lower protrusion of Japanese Patent No. 2646317 prevent a previous loop from moving upward by pressing the previous loop, and also have a function to pull down a knitting fabric. However, a knitting fabric is not sufficiently pulled down depending on knitting conditions, and thus there is a request for a more reliable pulling-down function.

SUMMARY

An object of an embodiment of the invention to provide a movable sinker apparatus and a sinker, of a weft knitting machine, that can retain and press down a knitting yarn of a previous loop and that can sufficiently pull down a knitting fabric.

An embodiment of the invention is directed to a movable sinker apparatus of a weft knitting machine having front and rear needle beds opposed to each other with a needle bed gap interposed therebetween, the movable sinker apparatus comprising:

sinkers arranged next to knitting needles, a knitting fabric being knitted by an interaction with knitting needles by applying a force of a spring so as to press down front end portions of the sinkers, and base portions of the sinkers being supported in a swingingly displaceable manner on the needle beds in the vicinity of the needle bed gap, and recessed portions for retaining and pressing down a knitting yarn of a previous loop that has been knitted being formed as knitting yarn receiving portions on front end portions of the sinkers moving forward into the needle bed gap, wherein the front end portion of the sinker has a shape of an arm extending to a lower portion of the needle bed gap in a circumferential direction with a substantially constant radius from the base portion, wherein on a portion closer to the front ends from a knitting yarn receiving portions on the arm are formed protruding portions that project outward in radial directions of swinging displacements, when the protruding portions are on a straight line linking between centers of swinging displacements of the base portions that are supported by the needle beds, the protruding portions of the sinkers are positioned closest toward the needle beds opposed thereto, and inclined faces inclined toward inner sides in the radial direction are respectively formed on the front end side and on the base portion side in the circumferential direction, and wherein the protruding portions of the sinkers provided on the needle beds that are opposed to each other pull down a knitting fabric in a lower portion of the needle bed gap, sandwiching the fabric therebetween.

Furthermore, an embodiment of the invention is directed to a sinker for use in a movable sinker apparatus having a base portion which is supported in a swingingly displaceable manner in a vicinity of a needle bed gap on a needle bed and a front end portion which is moved forward to the needle bed gap to knit a knitting fabric by an interaction with a knitting needle, the sinker comprising:

a front end portion having a shape of an arm extending to a lower portion of the needle bed gap in a circumferential direction with a substantially constant radius from the base portion, wherein the sinker is shaped into a plate, wherein on the arm are formed a first protruding portion that is formed between the base portion and the front end and that projects in a circumferential direction on the front end side, and a second protruding portion that is formed on a portion closer to the front end on the arm from the first protruding portion and that projects outward in a radial direction centered on the base portion, wherein on the base portion side in the circumferential direction in the first protruding portion, a knitting stitch forming edge used when a knitting yarn is pulled in with a hook of a knitting needle is formed, and wherein in the second protruding portion, inclined faces inclined toward inner sides in the radial direction are respectively formed on the front end side and on the base portion side on the arm.

BRIEF DESCRIPTION OF DRAWINGS

Other and further objects, features, and advantages of the invention will be more explicit from the following detailed description of example embodiments taken with reference to the drawings wherein.

DETAILED DESCRIPTION OF THE EXAMPLE EMBODIMENTS

Figure 1:
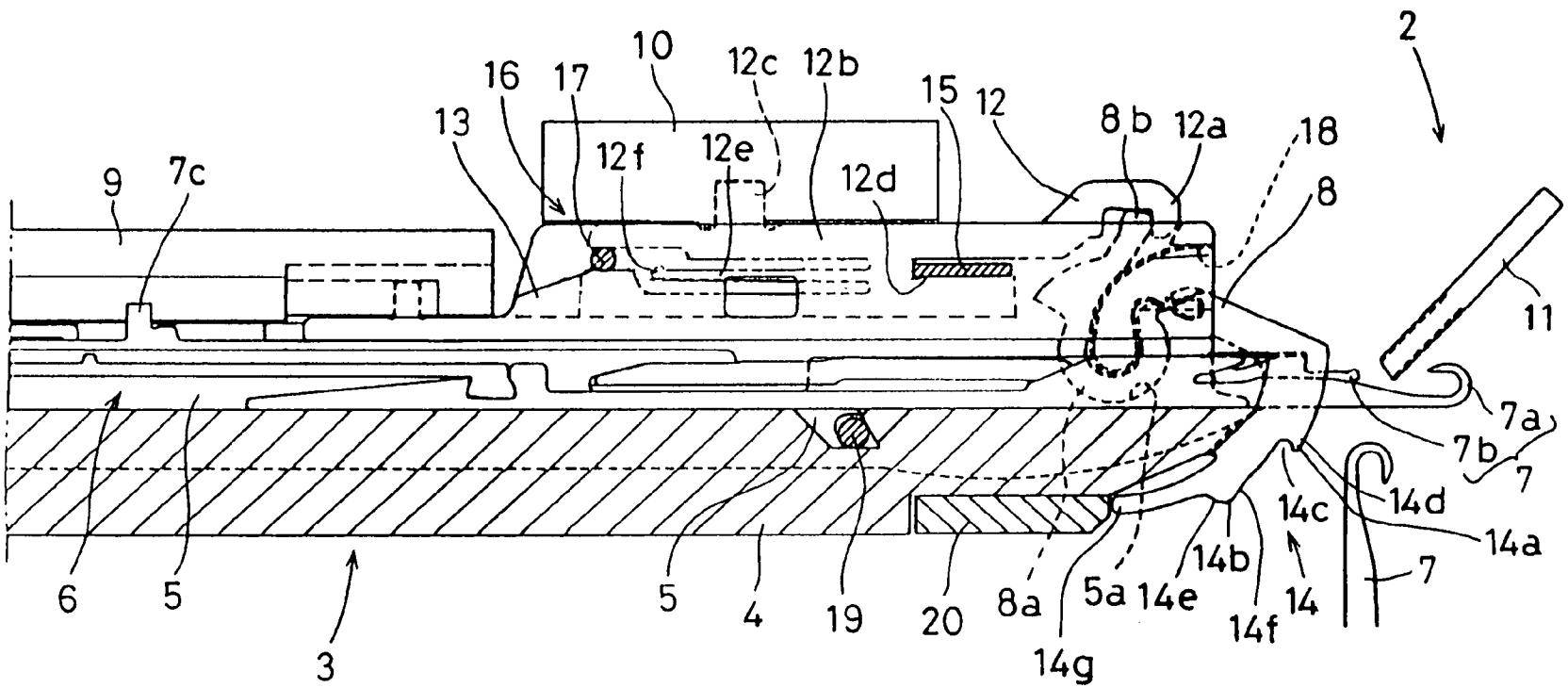
FIG. 1 is a side view showing the configuration of the main portions of a movable sinker apparatus 1 of a weft knitting machine according to an embodiment of the invention.

Now referring to the drawings, example embodiments of the invention are described below.

FIG. 1 shows the configuration of the main portions of a movable sinker apparatus 1 of a weft knitting machine according to an embodiment of the invention. The movable sinker apparatus 1 of a weft knitting machine is provided in a weft knitting machine in which front and rear needle beds are opposed to each other at a needle bed gap 2. In the drawing, one needle bed 3 is shown and the other needle bed is not shown. The needle bed 3 is inclined with respect to the needle bed gap 2 such that the needle bed 3 is high on the needle bed gap side and becomes lower as being away from the needle bed gap. In other words, the front and rear needle beds 3 are arranged in the shape of V upside down that is centered on the needle bed gap 2. However, for the sake of convenience, one needle bed 3 is shown in a horizontal state. The configuration of one needle bed 3 is basically similar to the configuration of the other needle bed.

On the needle bed 3, a large number of needle plates 5 are arranged in the direction toward the needle bed gap 2, which is an area for knitting a knitting fabric, on a base stage 4 that is disposed facing the needle bed gap 2. The needle plates 5 are formed such that the plate thickness is thin at the end portions on the needle bed gap 2 side. Needle grooves 6 having an increased width on the needle bed gap 2 side are formed between the needle plates 5. Knitting needles 7 are accommodated in the respective needle grooves 6, and sinkers 8 are accommodated at their respective end portions having an increased width. The needle bed 3 is thus configured. In the movable sinker apparatus 1 of a weft knitting machine, the knitting needles 7 are selectively moved back and forth with respect to the needle bed gap 2 while letting a carriage travel back and forth on the needle bed 3 along the needle bed gap 2, that is, in the direction perpendicular to the sheet of the drawing, so that a knitting fabric is knitted by an interaction with the sinkers 8. In the drawing, the carriage is not shown, and a knitting needle operation cam mechanism 9 for letting the knitting needles 7 operate and a sinker operation cam mechanism 10 for letting the sinkers 8 operate are shown.

In the needle bed gap 2, it is possible to form knitting loops by feeding a knitting yarn from a yarn feeder 11 to the knitting needle 7. The knitting needle 7 is disposed next to the sinker 8 in the width direction in each of the needle grooves 6, and is a compound needle in which a needle main portion 7*a* and a slider 7*b* can be independently displaced back and forth with respect to the needle bed gap 2. Although the needle main portion 7*a* is provided with a butt for driving a back and forth displacement with respect to the needle bed gap 2, the butt is not shown because it is on the left side of the drawing. The slider 7*b* is provided with a butt 7*c* for driving a back and forth displacement with respect to the needle bed gap 2. The needle plate 5 has, in its end portion on side of the needle bed gap 2, a recessed portion 5*a* that supports the sinker 8 in a swingingly displaceable manner.

The sinker 8 has a base portion 8*a* that is supported by the recessed portion 5*a*, and a passive portion 8*b* that is driven following the back and forth displacement with respect to the needle bed gap 2. A sinker jack 12 that can be linearly displaced back and forth with respect to the needle bed gap 2 is accommodated in each of the needle grooves 6. The sinker jack 12 is provided with an end portion 12*a* that is engaged with the passive portion 8*b* of the sinker 8, and has a butt 12*c* that projects in the direction away from the base stage 4 of the needle bed 3, on a base portion 12*b* side that extends in the direction away from the needle bed gap 2 with respect to the end portion 12*a*, and a cutout portion 12*d* that extends in the direction of the back and forth displacement in the middle between the end portion 12*a* and the base portion 12*b*.

A spacer 13 is disposed in the direction away from the base stage 4 of the needle bed 3 with respect to the knitting needle 7 in each of the needle grooves 6, and has the bottom portion regulating the knitting needle 7 so as not to move away from the base stage 4, and the side portion regulating the sinker jack 12 so as not to be shifted in the width direction of the needle groove 6. A metal band 15 penetrates the spacer 13 in each of the needle grooves 6 and the needle plate 5, in a direction along the needle bed gap, that is, a direction perpendicular to the sheet of the drawing so that the spacer 13 and the needle plate 5 are fixed together by the metal band 15. The metal band 15 is inserted also into the cutout portion 12*d* of the sinker jack 12, and functions as a penetrating member for regulating the sinker jack 12 so as to be slidingly displaced without moving away from the needle groove 6.

The sinker 8 of this embodiment has a front end portion 14 acting as a sinker with respect to the needle bed gap 2, in which a back and forth displacement thereof with respect to the passive portion 8*b* is converted into a swinging displacement using the base portion 8*a* as a fulcrum. A first protruding portion 14*a* and a second protruding portion 14*b* are formed on the front end portion 14. A knitting yarn receiving portion 14*c* and a knitting stitch forming edge 14*d* are formed in the first protruding portion 14*a*. Inclined faces 14*e* and 14*f* are formed on both sides in the second protruding portion 14*b*.

The sinker operation cam mechanism 10 provided on the carriage acts on the butt 12*c* of the sinker jack 12 to move the sinker jack 12 backward from the needle bed gap 2 such that the front end portion 14 of the sinker 8 is withdrawn from the needle bed gap 2. An interlock mechanism 16 is provided in order to interlock the sinker jack 12 in a backward position. In the interlock mechanism 16, a wire 17 interlocks a protrusion 12*f* at the front end of an extending portion 12*e*. The base portion 8*a* of the sinker 8 is provided with a wire spring 18 for biasing the sinker 8 clockwise in the drawing. A wire 19 is used to fix the needle plates 5 and the base stage 4. At a position close to the needle bed gap 2 of the bottom portion of the base stage 4, is provided a stopper 20 against which a front end 14*g* of the front end portion 14 of the sinker 8 abuts so that the swinging displacement of the sinker 8 by the force of the wire spring 18 is regulated.

Figure 2:
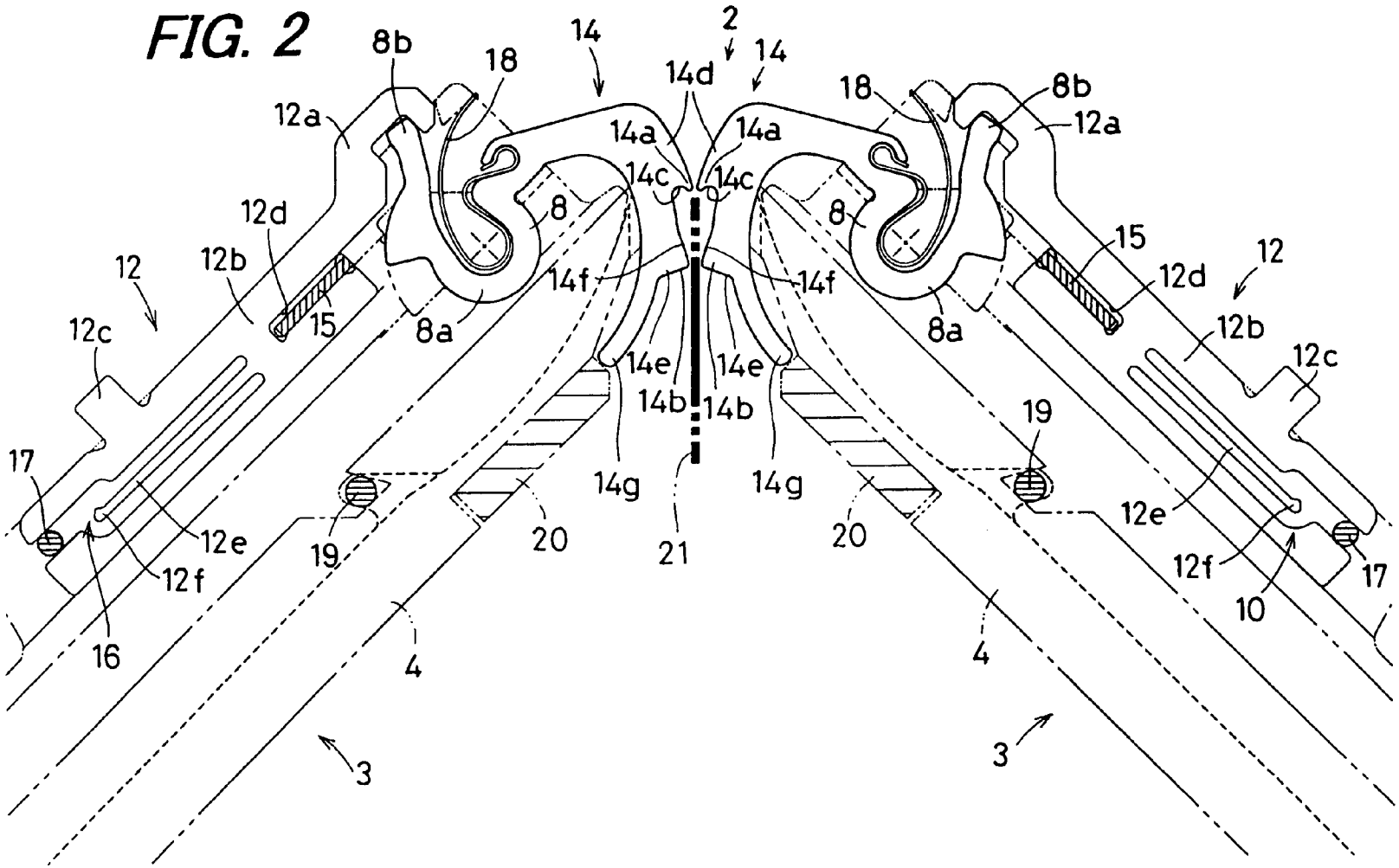
FIG. 2 is a side cross-sectional view of the vicinity of a needle bed gap 2 in a state where sinkers 8 are in forward positions in the weft knitting machine in FIG. 1.
Figure 3:
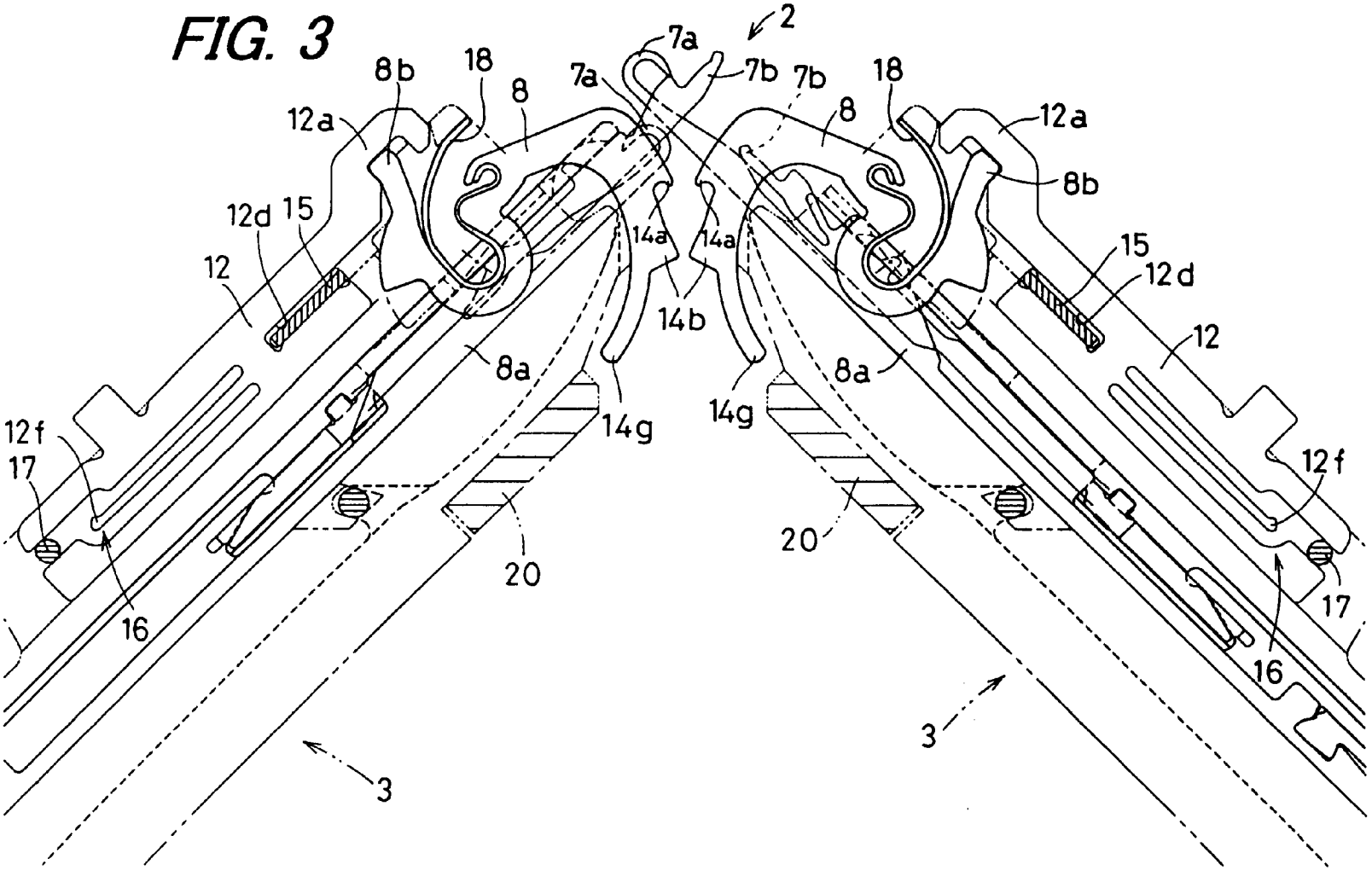
FIG. 3 is a side cross-sectional view of the vicinity of the needle bed gap 2 in a state where the sinkers 8 are in the forward positions in the weft knitting machine in FIG. 1.

FIG. 2 shows a state in which the sinkers 8 are in forward positions. FIG. 3 shows a state in which when the sinkers 8 are in the forward positions, the sinkers 8 have moved by the resisting force from a knitting yarn backward by the amounts of gaps provided at the end portions 12*a* of the sinker jacks 12. At forward positions of the sinkers 8, the second protruding portions 14*b* of the front end portions 14 that have moved forward from the front and rear needle beds 3 into the needle bed gap 2 are close to each other, and thus a knitting fabric 21 can be sandwiched therebetween. When the front and rear needle beds 3 are faced each other so as to be symmetric at the needle bed gap 2, the forces of the wire springs 18 are applied so as to pull down the knitting fabric 21 in the vertical direction.

The first protruding portion 14*a* of the front end portion 14 on the sinker 8 is provided, at a portion close to the front end 14*g*, with the knitting yarn receiving portion 14*c* as a recess inward in the radial direction of a swinging displacement, and thus it is possible to retain a knitting yarn of a previous loop when the knitting needle 7 moves forward into the needle bed gap 2 in a knitting operation of a knitting fabric. A portion close to the base portion 8*a* of the first protruding portion 14*a* is provided with the knitting stitch forming edge 14*d*, and thus it is possible to catch a knitting yarn that is supplied from the yarn feeder 11 when the needle main portion 7*a* is pulled in by the stitch cam of the carriage to determine the stitch density of a knitting stitch formed with the hook of the needle main portion 7*a*.

Figure 4:
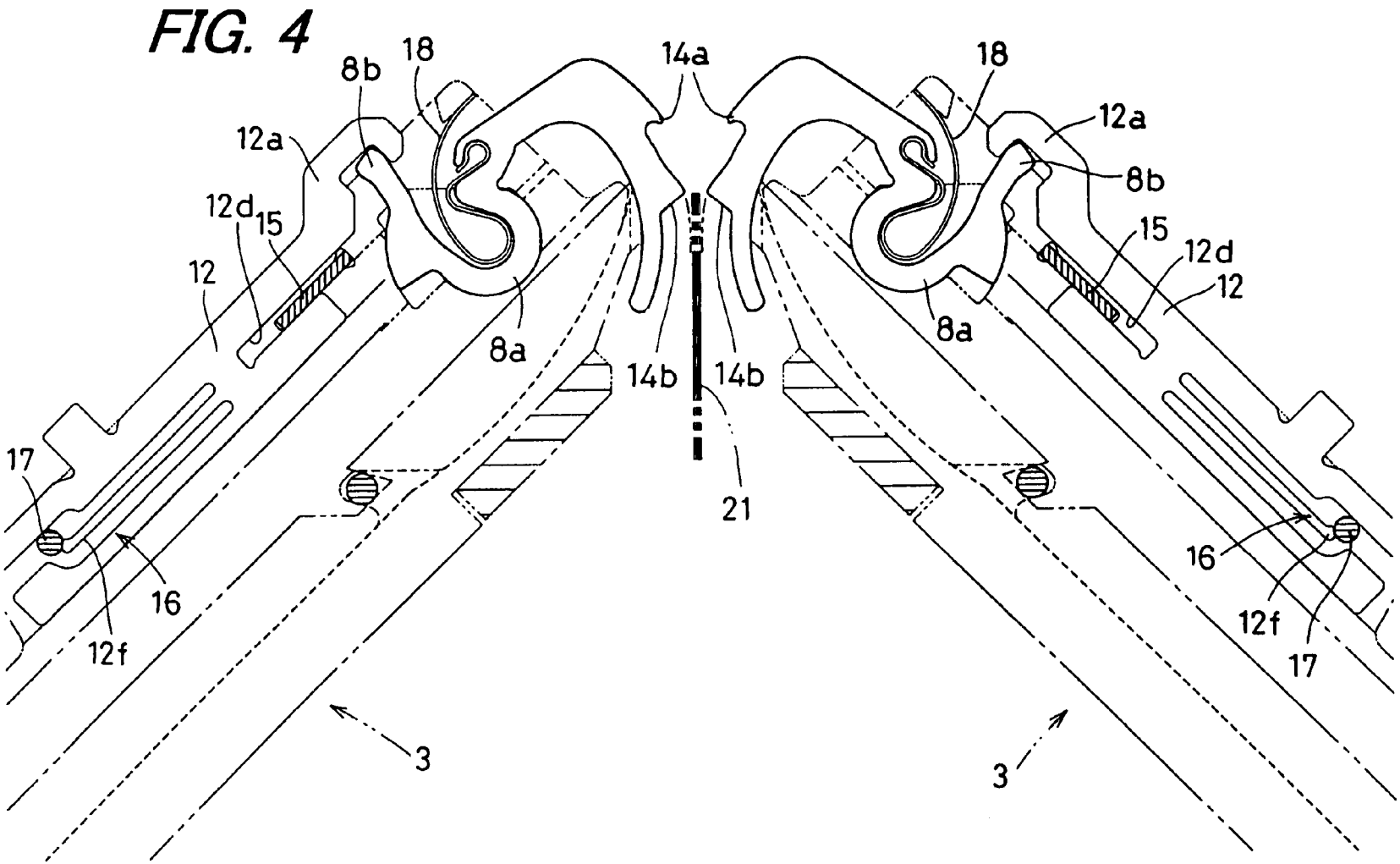
FIG. 4 is a side cross-sectional view of the vicinity of the needle bed gap 2 in a state where the sinkers 8 are in backward positions in the weft knitting machine in FIG. 1.

FIG. 4 shows a state in which the sinkers 8 are in the backward positions. It is possible to reliably press a knitting fabric by moving the sinkers 8 between the forward positions shown in FIGS. 2 and 3 and the backward positions shown in FIG. 4 in accordance with the knitting operation of the knitting needles 7. In a case where a resisting force that is greater than the force of the wire spring 18 is received from a knitting yarn when pressing a knitting force, it is possible to relax the tensile force of the knitting yarn by moving the sinker 8 backward.

FIGS. 2 to 4 show that the metal bands 15 function as guide members for regulating a sliding displacement such that the sinker jacks 12 do not move away from the needle plates 5, by fitting into the cutout portions 12*d* of the sinker jacks 12. Furthermore, FIGS. 2 and 3 show that in the forward positions, the end portions of the cutout portions 12*d* abut against the side ends of the metal bands 15, and thus the metal bands 15 function also as stoppers.

Figure 5:
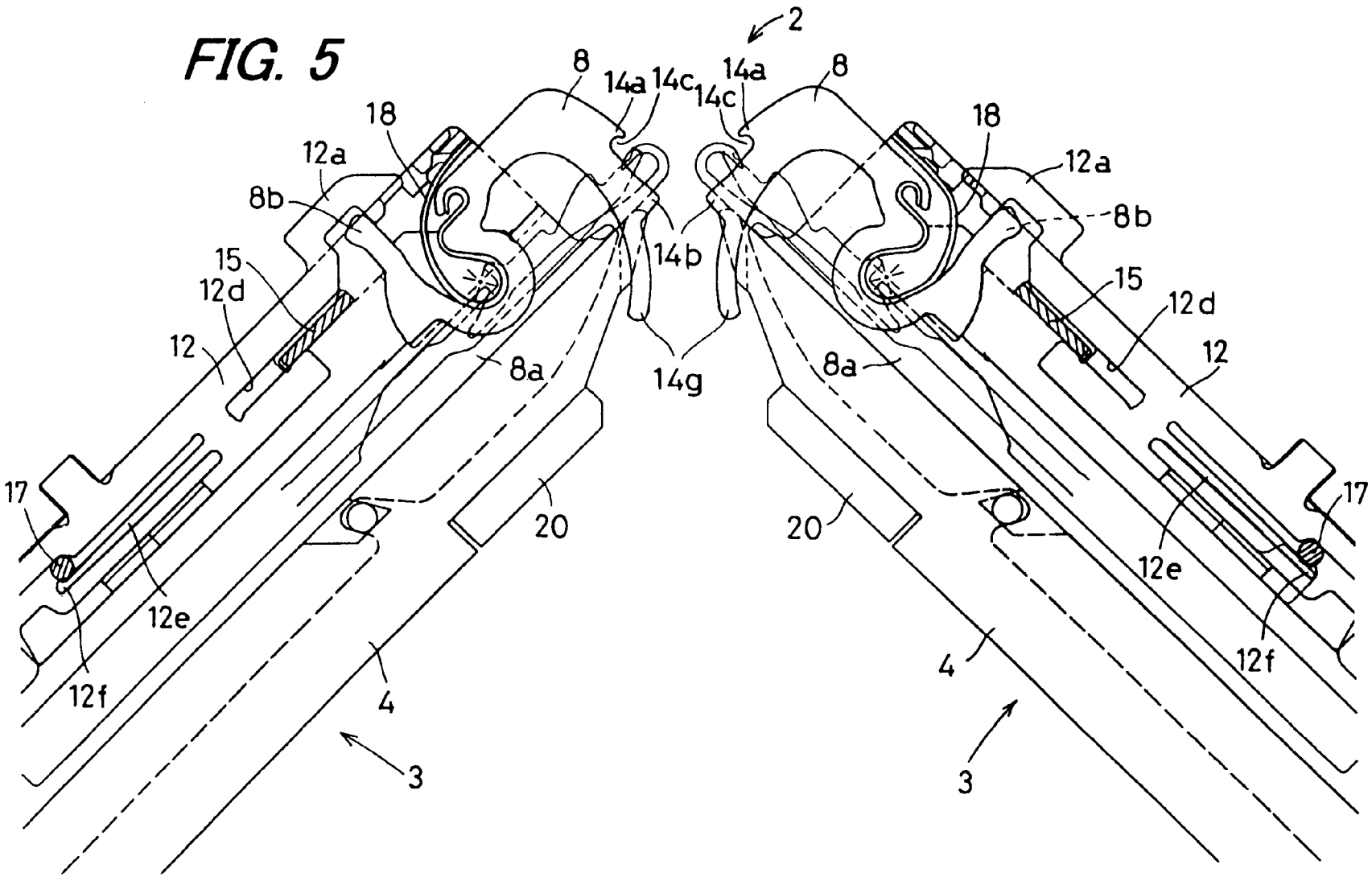
FIG. 5 is a side cross-sectional view of the vicinity of the needle bed gap 2 in a state where the sinkers 8 are in rest positions in the weft knitting machine in FIG. 1.

FIG. 5 shows a state in which the sinker jacks 12 have been moved to the rearmost from the side of the needle bed gap 2 and the protrusions 12*f* are interlocked with the wires 17 in the interlock mechanisms 16. The sinkers 8 are in rest positions. On the sinker jacks 12, the extending portions 12*e* whose front ends are provided with the protrusions 12*f* function as cantilevers for the base portions 12*b*, and can be elastically deformed when the wires 17 surmount the protrusions 12*f*. As long as this force causing the elastic deformation is not applied from the outside, the interlock mechanisms 16 can keep the state in which the sinkers 8 are in the rest positions.

Figure 6:
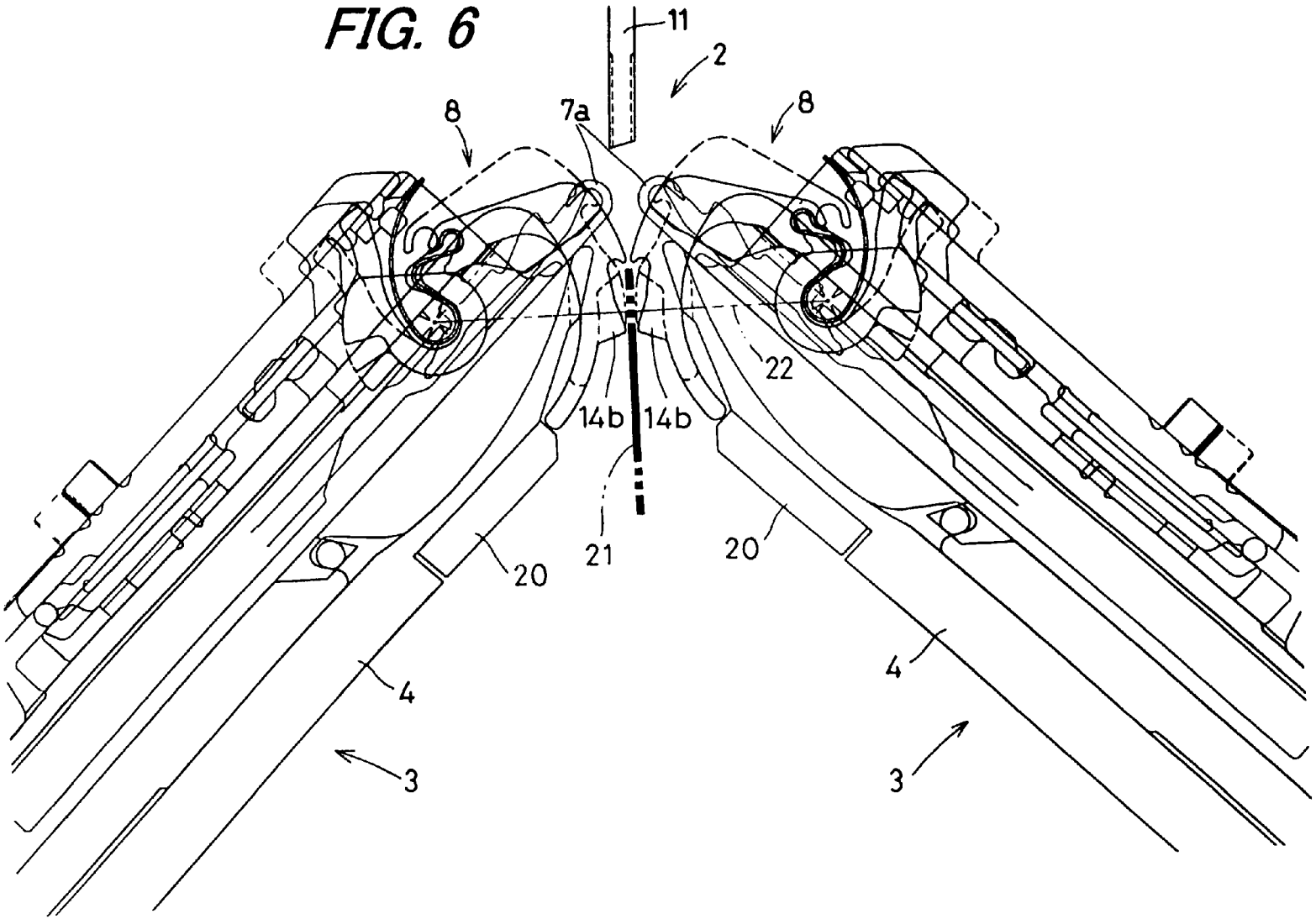
FIG. 6 is a side cross-sectional view of the vicinity of the needle bed gap 2 comparing states in which the sinkers 8 are in the various positions in the weft knitting machine in FIG. 1.

In FIG. 6, a state in which the sinkers 8 are in the forward positions is indicated by the solid line, and a state in which the sinkers 8 are in the backward positions is indicated by the broken line. Furthermore, a straight line 22 linking between the center positions of swinging displacements of the base portions 8*a* of the sinkers 8 on the front and rear needle beds 3 is indicated by the dashed double dotted line. It is preferable that the second protruding portions 14*b* are below the straight line 22 at the forward positions, and are above the straight line 22 at the backward positions. In the vicinity of the straight line 22, the knitting fabric 21 is to be sandwiched between the second protruding portions 14*b* of the sinkers 8 on the front and rear needle beds 3. On this straight line, the forces of the wire springs 18 are applied downward in the vertical direction, and thus it is possible to sufficiently pull down the knitting fabric 21.

More specifically, the sinkers 8 can be displaced by the forces of the wire springs 18 downward until the front ends 14*g* abut against the stoppers 20, and can move upward by the amounts of gaps at the engagement portions between the end portions 12*a* of the sinker jacks 12 and the passive portions 8*b* of the sinkers 8 when a reaction force is received, and thus a sufficient effect for pressing and pulling down a knitting stitch of a previous loop is obtained.

In particular, the locus of the second protruding portions 14*b* formed in swinging displacements are in the vertical direction that is perpendicular to the horizontal straight line 22 linking between the swinging centers of the sinkers 8 on both needle beds, and thus a pulling-down effect with a sufficient stroke with respect to a knitting fabric is obtained. Furthermore, the inclined faces 14*e* and 14*f* are formed on both sides in the second protruding portions 14*b*, and thus the second protruding portions 14*b* are easily removed from a knitting stitch of the knitting fabric, so that it is possible prevent the knitting fabric from being brought upward when the sinkers 8 are returned upward.

Accordingly, the movable sinker apparatus 1 of a weft knitting machine is provided with the sinkers 8 that are arranged next to the knitting needles 7 on each of the needle beds 3, in a weft knitting machine in which the front and rear needle beds 3 are opposed to each other with the needle bed gap 2 interposed therebetween. On the needle beds 3 in the vicinity of the needle bed gap 2 in which the knitting fabric 21 is knitted by moving the knitting needles 7 forward from the needle beds 3, the base portions 8*a* of the sinkers 8 are supported in a swingingly displaceable manner.

The knitting yarn receiving portions 14*c* that are recessed portions for retaining and pressing down a knitting yarn of a previous loop are formed at the front end portions 14 of the sinkers 8 that move forward into the needle bed gap 2. The forces of the wire springs 18 are applied so as to press down the front end portions 14 of the sinkers 8, and the knitting fabric 21 is knitted by an interaction with the knitting needles 7. The second protruding portions 14*b* that project outward in the radial directions of swinging displacements from the base portions 8*a* of the sinkers 8 are formed on a portion closer to the front ends 14*g* from the knitting yarn receiving portions 14*c* in the front end portions 14 of the sinkers 8.

The knitting fabric 21 in a lower portion of the needle bed gap 2 is sandwiched and pulled down by the second protruding portions 14*b* of the sinkers 8 provided on the needle beds 3 that are opposed to each other. Since the fabric 21 in a lower portion of the needle bed gap 2 is sandwiched and pulled down by the second protruding portions 14*b* of the sinkers 8 provided on the needle beds 3 that are opposed to each other, it is possible to sufficiently pull down the knitting fabric 21 in a lower portion of the needle bed gap 2.

Furthermore, the second protruding portions 14*b* of the sinkers 8 are positioned closest toward the front and rear needle beds 3 opposed thereto, when the second protruding portions 14*b* are on the straight line 22 linking between the centers of swinging displacements of the base portions 8*a* that are supported by the needle beds 3, and thus it is possible to sandwich the knitting fabric 21 from both sides. When the front and rear needle beds 3 are made symmetric, the straight line 22 becomes horizontal, and thus the forces applied on the knitting fabric 21 when the sinkers 8 are swingingly displaced are directed downward in the vertical direction, so that it is possible to sufficiently pull down the knitting fabric 21.

Figure 7:
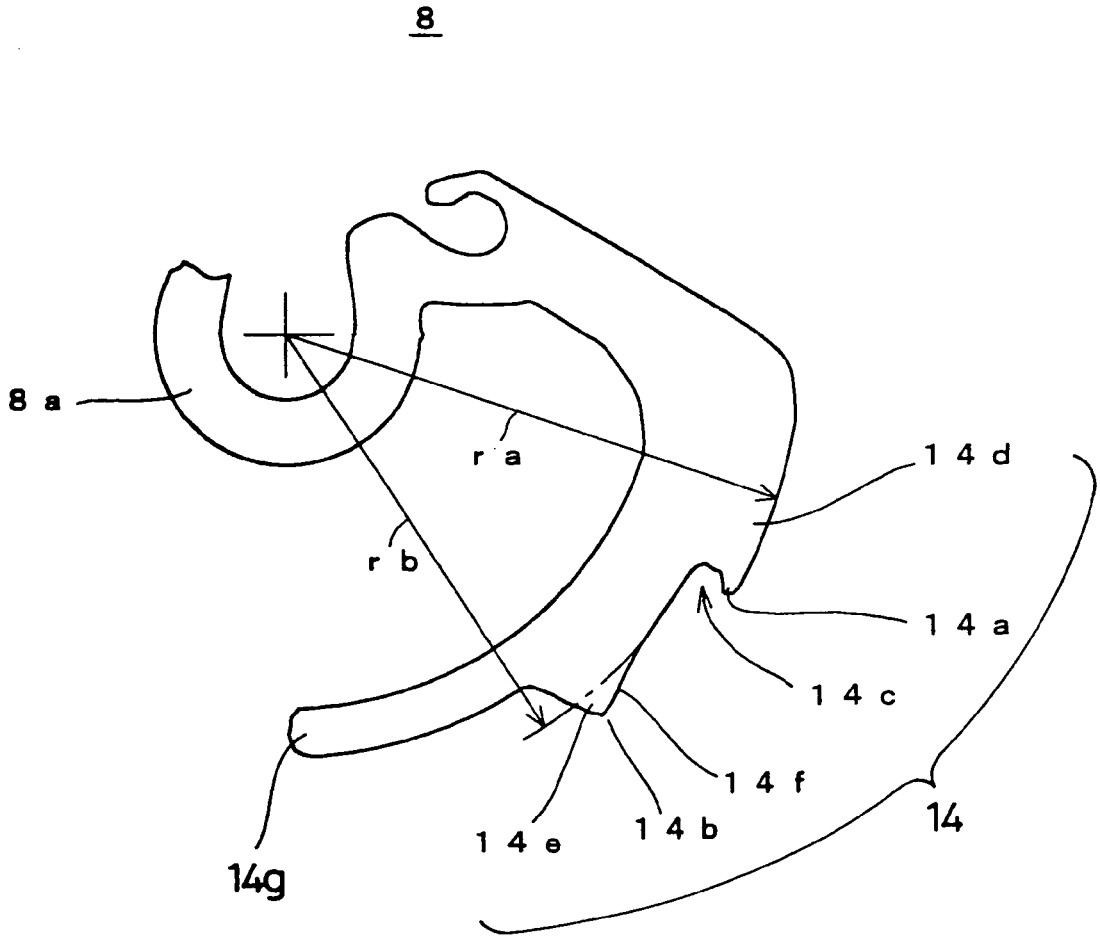
FIG. 7 is a side view showing the shape of the sinker 8 in FIG. 1.

FIG. 7 shows the shape of the sinker 8 excluding the passive portion 8*b*. The sinker 8 is formed by, for example, punching or cutting a metal plate, and has the base portion 8*a*, the passive portion 8*b* that is not shown, and the front end portion 14. The front end portion 14 has the shape of an arm that extends to a lower portion of the needle bed gap 2 in the circumferential direction with a substantially constant radius from the base portion 8*a*. On the arm of the front end portion 14 are formed the first protruding portion 14*a* that is formed between the base portion 8*a* and the front end 14*g* and that projects in the circumferential direction on the front end side, and the second protruding portion 14*b* that is formed on a portion closer to the front end 14*g* on the arm from the first protruding portion 14*a* and that projects outwards in the radial direction centered on the base portion 8*a*.

On the inner side in the radial direction in the first protruding portion 14*a*, a recessed portion having the recessed face on the front end 14*g* side is formed as the knitting yarn receiving portion 14*c* that retains and presses down a knitting yarn of a previous loop of a knitting fabric. On the base portion 8*a* side in the circumferential direction in the first protruding portion 14*a*, a face with a substantially constant radius ra is formed as the knitting stitch forming edge 14*d*. The knitting stitch forming edge 14*d* is pulled into the needle groove on the needle bed 3 such that the knitting needle 7 is moved backward with the stitch cam from the needle bed gap 2, and thus the stitch density is determined when a knitting stitch is formed with a hook 7*c*. In a knitting stitch that is formed, a portion that was hooked on the knitting stitch forming edge 14*d* is formed as a sinker loop.

The second protruding portion 14*b* is formed so as to project outward in the radial direction from an arc with a radius rb that extends from the knitting stitch receiving portion 14*c* toward the front end 14*g*. The radius rb is smaller than the radius ra from the first protruding portion 14*a* to the knitting stitch forming edge 14*c* by the width of the knitting yarn receiving portion 14*c*. The front end of the second protruding portion 14*b* projects outward in the radial direction from the radius rb with respect to the base portion 8*a*. The inclined faces 14*e* and 14*f* inclined toward the inner sides in the radial direction are respectively formed on both sides in the circumferential direction in the second protruding portion 14*b*.

The sinker 8 has the base portion 8*a* that is supported in a swingingly displaceable manner in the vicinity of the needle bed gap 2 on the needle bed 3 of a weft knitting machine, and is used in the movable sinker apparatus 1 of a weft knitting machine in which the front end portion 14 is moved forward into the needle bed gap 2 and thus the knitting fabric 21 is knitted by an interaction with the knitting needle 7. The sinker 8 has the shape of a plate, and the front end portion 14 has the shape of an arm that extends to a lower portion of the needle bed gap 2 in the circumferential direction with a substantially constant radius from the base portion 8*a*.

The knitting yarn receiving portion 14*c* and the knitting stitch forming edge 14*d* that are provided in the first protruding portion 14*a* of the front end portion 14 of the sinker 8 knit the knitting fabric 21 by an interaction with the knitting needle 7, and thus it is possible to reliably form a knitting stitch. The knitting fabric 21 in a lower portion of the needle bed gap 2 is sandwiched and pulled down by the second protruding portions 14*b* of the sinkers 8 provided on the needle beds 3 that are opposed to each other, and thus it is possible to sufficiently pull down the knitting fabric 21 in the lower portion of the needle bed gap 2.

Furthermore, in the second protruding portion 14*b*, the inclined faces 14*e* and 14*f* inclined toward the inner sides in the radial direction are respectively formed on the front end 14*g* side on the arm of the front end portion 14 and on the base end 8*a* side on the sinker 8. Even when the second protruding portion 14*b* has moved into a knitting stitch of the knitting fabric 21, with a swinging displacement centered on the base portion 8*a*, it is possible to easily remove the second protruding portion 14*b* from the knitting stitch of the sandwiched knitting fabric 21.

In particular, even when a knitting fabric is pulled upward and the tensile force is applied while transferring a stitch, since the inclined faces 14*e* and 14*f* are formed, it is easy to remove the second protruding portion 14*b*, and thus it is possible to prevent a yarn from being broken. Furthermore, even when the sinker 8 is moved backward from the needle bed gap 2, it is easy to remove the second protruding portion

14*b* from a knitting stitch, and thus it is possible to prevent a knitting fabric from being brought upward.

It is sufficient that the carriage on which the knitting needle operation cam mechanism 9 and the sinker operation cam mechanism 10 described above are mounted is provided on each of the front and rear needle beds 3, and that the front and rear carriages can move back and forth in the longitudinal direction of the needle beds 3 in conjunction with each other. It is sufficient that needle selection mechanisms for selecting the knitting needles 7 that are used for knitting in accordance with knitting data of a knitting fabric are also provided on the carriages. The configuration thereof and the knitting operation by an interaction between the knitting needles 7 and the sinkers 8 are similar to those already known, and thus a description thereof has been omitted.

As described above, the front end portion 14 of the sinker 8 is provided with the first protruding portion 14*a* and the second protruding portion 14*b*. The function of the second protruding portion 14*b* is not provided in conventional sinkers. On the sinker of JP-B2 05-83657, the knitting yarn receiving portion is formed on the front end side that moves forward into the needle bed gap, and the outer side portion in the radial direction serves as the protruding portion. The protruding portion has a function to prevent a knitting yarn of a previous loop from moving to the needle bed gap as the knitting needle moves forward into the needle bed gap, by catching the knitting yarn of the previous loop. The lower protrusion of Japanese Patent No. 2646317 has a function similar to that of the protruding portion of JP-B2 05-83657.

The function of the first protruding portion 14*a* of this embodiment is the same as those of the protruding portion of JP-B2 05-83657 and the lower protruding portion of Japanese Patent No. 2646317. In JP-B2 05-83657 and Japanese Patent No. 2646317, the protrusions are for catching a knitting yarn of a previous loop thereby preventing the knitting yarn from moving as the knitting needle moves forward into the needle bed gap, and thus the acting position (knitting stitch) is at a previous loop (knitting stitch that is still on the knitting needle), so that knitting stitches on the lower side are not sufficiently taken into consideration. However, the second protruding portion 14*b* of this embodiment acts on the lower side (knitting stitches formed before the previous stitch) of the protruding portions in JP-B2 05-83657 and Japanese Patent No. 2646317.

Accordingly, effects as below are obtained.

1. In the case of a coarse knitting fabric, even when the knitting fabric cannot be pressed by the first protruding portion 14*a*, it is possible to press the knitting fabric with the second protruding portion 14*b* (auxiliary role for the first protruding portion 14*a*).
2. During knitting, a pulling-down effect of the second protruding portion 14*b* can be obtained in addition to a pressing-down effect of the first protruding portion 14*a*. Thus, it is not necessary to use an apparatus for pulling down a knitting fabric.
3. When knitting of the last course ends and a knitting stitch is released from the knitting needle 7, it is possible to reliably drop the knitting fabric by pulling down the knitting fabric with the second protruding portion 14*b* such that a dropping failure is not caused by the knitting fabric stuck in the sinkers in a portion on the lower side of the first protruding portion 14*a*. In particular, a knitting fabric is easily stuck when the knitting fabric is thick or tubular, or in the form of gloves or small products having a light self-weight.

It would be appreciated that it is also possible to provide an apparatus for pulling down a knitting fabric in a lower portion of the needle bed gap 2 in Effects 2 or 3 described above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to an embodiment of the invention, base portions of sinkers are supported in a swingingly displaceable manner by needle beds in the vicinity of a needle bed gap in which knitting needles move forward from the needle beds and thus a knitting fabric is knitted. On front end portions of the sinkers moving forward into the needle bed gap, knitting yarn receiving portions are formed that are recessed portions for retaining and pressing down a knitting yarn of a previous loop. When a force of a spring is applied so as to press down the front end portions of the sinkers, a knitting fabric can be knitted by an interaction with the knitting needles.

Protruding portions that project outward in radial directions of swinging displacements are formed on a portion closer to the front ends from the knitting yarn receiving portions in the front end portions of the sinkers. A knitting fabric in a lower portion of the needle bed gap is sandwiched and pulled down by the protruding portions of the sinkers provided on the needle beds that are opposed to each other, and thus it is possible to sufficiently pull down the knitting fabric in the lower portion of the needle bed gap.

Furthermore, the protruding portions of the sinkers are positioned closest toward the needle beds opposed thereto, when the protruding portions are on a straight line linking between the centers of swinging displacements of the base portions of the sinkers that are supported in the vicinity of the needle bed gap on the needle beds, and thus it is possible to sandwich the knitting fabric from both sides. When the front and rear needle beds are made symmetric, the straight line becomes horizontal, and thus the forces applied on the knitting fabric when the sinkers are swingingly displaced are directed downward in the vertical direction, so that it is possible to sufficiently pull down the knitting fabric.

Furthermore, in the protruding portion of the front end portion of the sinker, inclined faces inclined toward inner sides in the radial direction of a swinging displacement centered on the base portion are respectively formed on the front end side and on the base end side on the arm, and thus with a swinging displacement, it is possible to easily remove the second protruding portion from a knitting stitch of a sandwiched knitting fabric. In particular, even when a knitting fabric is pulled upward and the tensile force is applied while transferring a stitch, since the inclined faces are formed, it is easy to remove the second protruding portion, and thus it is possible to prevent a yarn from being broken.

Furthermore, according to an embodiment of the invention, a sinker can be used in a movable sinker apparatus in which its base portion is supported in a swingingly displaceable manner in the vicinity of a needle bed gap on a needle bed of a weft knitting machine and in which its front end portion is moved forward into the needle bed gap and thus a knitting fabric is knitted by an interaction with a knitting needle. The front end portion of the sinker has the shape of an arm that extends to a lower portion of the needle bed gap in a circumferential direction with a substantially constant radius from the base portion. On the arm are formed a first protruding portion that is formed between the base portion and the front end and that projects in the circumferential direction on the front end side, and a second protruding portion that is formed on a portion closer to the front end on the arm from the first protruding portion and that projects outward in a radial direction centered on the base portion.

A knitting yarn receiving portion and a knitting stitch forming edge that are provided in the first protruding portion knit a knitting fabric by an interaction with the knitting needle, and thus it is possible to reliably form a knitting stitch. A knitting fabric in a lower portion of the needle bed gap is sandwiched and pulled down by the second protruding portions of the sinkers provided on the needle beds that are opposed to each other, and thus it is possible to sufficiently pull down the knitting fabric in the lower portion of the needle bed gap.

Furthermore, according to an embodiment of the invention, in the second protruding portion of the front end portion of the sinker, inclined faces inclined toward inner sides in the radial direction of a swinging displacement centered on the base portion are respectively formed on the front end side and on the base end side on the arm, and thus with a swinging displacement, it is possible to easily remove the second protruding portion from a knitting stitch of a sandwiched knitting fabric. In particular, even when a knitting fabric is pulled upward and the tensile force is applied while transferring a stitch, since the inclined faces are formed, it is easy to remove the second protruding portion, and thus it is possible to prevent a yarn from being broken.

The invention claimed is:

1. A movable sinker apparatus of a weft knitting machine having front and rear needle beds opposed to each other with a needle bed gap interposed therebetween, the movable sinker apparatus comprising:

sinkers arranged next to knitting needles, a knitting fabric being knitted by an interaction with knitting needles by applying a force of a spring so as to press down front end portions of the sinkers, and base portions of the sinkers being supported in a swingingly displaceable manner on the needle beds in the vicinity of the needle bed gap, and recessed portions for retaining and pressing down a knitting yarn of a previous loop that has been knitted being formed as knitting yarn receiving portions on front end portions of the sinkers moving forward into the needle bed gap, wherein the front end portion of the sinker has a shape of an arm extending to a lower portion of the needle bed gap in a circumferential direction with a substantially constant radius from the base portion, wherein on a portion closer to the front ends from a knitting yarn receiving portions on the arm are formed protruding portions that project outward in radial directions of swinging displacements, when the protruding portions are on a straight line linking between centers of swinging displacements of the base portions that are supported by the needle beds, the protruding portions of the sinkers are positioned closest toward the needle beds opposed thereto, and inclined faces inclined toward inner sides in the radial direction are respectively formed on the front end side and on the base portion side in the circumferential direction, and wherein the protruding portions of the sinkers provided on the needle beds that are opposed to each other pull down a knitting fabric in a lower portion of the needle bed gap, sandwiching the fabric therebetween.

* * * * *